US011380241B2

(12) United States Patent
Kim et al.

(10) Patent No.: US 11,380,241 B2
(45) Date of Patent: Jul. 5, 2022

(54) DISPLAY APPARATUS AND METHOD FOR DRIVING THE SAME

(71) Applicant: Samsung Display Co., Ltd., Yongin-si (KR)

(72) Inventors: Min Gyu Kim, Hwaseong-si (KR); Hee Joon Kim, Yongin-si (KR); Si Hun Jang, Hwaseong-si (KR); Hoi Sik Moon, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1 day.

(21) Appl. No.: 17/093,117

(22) Filed: Nov. 9, 2020

(65) Prior Publication Data

US 2021/0272502 A1 Sep. 2, 2021

(30) Foreign Application Priority Data

Mar. 2, 2020 (KR) ..... 10-2020-0026149

(51) Int. Cl.
*G09G 3/20* (2006.01)

(52) U.S. Cl.
CPC ..... *G09G 3/2007* (2013.01); *G09G 3/2003* (2013.01); *G09G 2300/0452* (2013.01); *G09G 2310/08* (2013.01); *G09G 2320/0276* (2013.01)

(58) Field of Classification Search
CPC ..... G09G 2300/0452; G09G 2310/08; G09G 2320/0276; G09G 2320/0285; G09G 2320/0673; G09G 3/2003; G09G 3/2007; G09G 3/2092
See application file for complete search history.

(56) References Cited

U.S. PATENT DOCUMENTS

2011/0187755 A1* 8/2011 Choi ..... G09G 5/10 345/690
2016/0171939 A1* 6/2016 Na ..... G09G 3/2003 345/690

FOREIGN PATENT DOCUMENTS

| | | | |
|---|---|---|---|
| JP | 5476289 | B2 | 4/2014 |
| JP | 6177606 | B2 | 8/2017 |
| KR | 10-0612301 | B1 | 8/2006 |
| KR | 10-2016-0070911 | A | 6/2016 |
| KR | 10-1650779 | B1 | 8/2016 |

* cited by examiner

*Primary Examiner* — Kenneth Bukowski
(74) *Attorney, Agent, or Firm* — Lewis Roca Rothgerber Christie LLP

(57) ABSTRACT

A display device according to some embodiments includes a display panel including a plurality of pixels, a timing controller for correcting an input image signal, and for transmitting the input image to the display panel, a memory for storing model correction data for correcting a gray value, the model correction data corresponding to respective models of a plurality of timing controllers, and for storing image quality correction data for correcting a gamma deviation of the display panel, and a correction controller for generating final correction data by using the model correction data and the image quality correction data, and for transmitting the final correction data to the timing controller.

20 Claims, 5 Drawing Sheets

FIG. 5

| | MODEL 1 | | | MODEL 2 | | | MODEL 3 | | |
|---|---|---|---|---|---|---|---|---|---|
| ID CODES | ABC5501122 | | | DEF5501234 | | | CSE5523512 | | |
| GRAYS | R | G | B | R | G | B | R | G | B |
| 0 | 0 | 0 | 0 | 0 | 0 | 0 | 0 | 0 | 0 |
| 1 | 16 | 16 | 16 | 16 | 15 | 14 | 15 | 13 | 17 |
| 2 | 32 | 32 | 32 | 24 | 27 | 32 | 28 | 20 | 33 |
| 3 | ··· | ··· | ··· | ··· | ··· | ··· | ··· | ··· | ··· |
| 4 | ··· | ··· | ··· | ··· | ··· | ··· | ··· | ··· | ··· |
| ··· | ··· | ··· | ··· | ··· | ··· | ··· | ··· | ··· | ··· |
| 255 | ··· | ··· | ··· | ··· | ··· | ··· | ··· | ··· | ··· |

DISPLAY APPARATUS AND METHOD FOR DRIVING THE SAME

CROSS-REFERENCE TO RELATED APPLICATION

This application claims priority to, and the benefit of, Korean Patent Application No. 10-2020-0026149 filed in the Korean Intellectual Property Office on Mar. 2, 2020, the entire contents of which are incorporated herein by reference.

BACKGROUND

1. Field

The present disclosure relates to a display device, and to a driving method thereof.

2. Description of the Related Art

A display device displays an image, which corresponds to a digital image signal received from a source, on a display panel. The display panel includes a plurality of pixels to which analog signals (e.g., data voltages), which are generated by processing digital image signals, are applied. The respective pixels emit light according to applied voltages (e.g., as an OLED display), or control intensity of light passing through liquid crystal according to liquid crystal transmittance that is adjustable by the applied voltages (e.g., as an LCD display).

When a thin film transistor process for producing display panels is performed, beams may be irradiated to the display panels with different exposure amounts because of limitations of the equipment. However, the difference of amounts of exposure generates deviation of amounts of irradiation, which changes the characteristic of image quality, thereby generating a drawback of a gamma deviation. To reduce the gamma deviation, respective display panels store image quality correction data in a memory by using luminance measured by use of an image-testing, or vision-testing, device.

The display panel generated by the same process may include a timing controller of a different model depending on users' needs. However, addresses of the memory in which the image quality correction data are stored are different for respective models of the timing controller, and the respective models may have different respective measured gamma values and target gamma values of the display panel. Therefore, display panels generated by the same process may reduce the gamma deviation when the timing controller of a corresponding model is used therewith, and it may be difficult to mount different models of timing controllers to the display panels.

The above information disclosed in this Background section is only for enhancement of understanding of the background of embodiments of the present disclosure and therefore it may contain information that does not form the prior art that is already known in this country to a person of ordinary skill in the art.

SUMMARY

The present disclosure may enable the reduction of a gamma deviation of a display panel.

The present disclosure may enable correction of image quality when a model of a combined timing controller varies.

Some embodiments of the present disclosure provide a display device including a display panel including a plurality of pixels, a timing controller for correcting an input image signal, and for transmitting the input image to the display panel, a memory for storing model correction data for correcting a gray value, the model correction data corresponding to respective models of a plurality of timing controllers, and for storing image quality correction data for correcting a gamma deviation of the display panel, and a correction controller for generating final correction data by using the model correction data and the image quality correction data, and for transmitting the final correction data to the timing controller.

The gamma deviation may include a difference between a measured gamma of the display panel when driven by a timing controller of a first model and a target gamma of the timing controller of the first model.

The gamma corrected by the model correction data may represent a gamma difference value corresponding to a difference between a difference value between a center-value gamma of the timing controller of the first model and a target gamma of the timing controller of the first model, and a difference value between a center-value gamma of a timing controller of a second model and a target gamma of the timing controller of the second model, wherein the center-value gamma includes a representative value of measured gammas for respective gray levels when driven by the timing controller of a given model of a plurality of display panels generated in a same manufacturing process as the display panel.

The center-value gamma may include a mean value or an intermediate value of measured gammas for respective gray levels of the plurality of display panels generated in the same manufacturing process.

The gamma value corrected by the final correction data may be calculated by using $g(x)=CB(x)+d2-TB(x)$, $f(x)=CA(x)+d1-TA(x)$, $CA(x))=CB(x)+X$, and wherein, when $d1=d2$, $g(x)=CA(x)-X+d1-TB(x)=f(x)+(TB(x)-CB(x))-(TA(x)-CA(x))$, where $g(x)$ includes a gamma value corrected by the final correction data, $CB(x)$ includes a center-value gamma of the timing controller of the second model, $d2$ includes a gamma deviation of a display panel corrected corresponding to the timing controller of the second model, $TB(x)$ includes a target gamma of the timing controller of the second model, $f(x)$ includes a gamma value corrected by the image quality correction data, $CA(x)$ includes a center-value gamma of the timing controller of the first model, $d1$ includes a gamma deviation of the display panel corrected corresponding to the timing controller of the first model, and $TA(x)$ includes a target gamma of the timing controller of the first model.

A target gamma of the timing controller of the first model may be different from a target gamma of the timing controller of the second model.

The image quality correction data may be stored in different addresses of the memory according to a model of the timing controller.

The timing controller may be configured to correct the image signal by using the final correction data, wherein the correction controller is configured to store the final correction data in the memory.

The model correction data and the image quality correction data may be stored in a lookup table (LUT).

The pixels may respectively include red, green, and blue sub-pixels, wherein the image signal includes red, green, and blue data.

Other embodiments of the present disclosure provide a method for driving a display device as a method for driving a display device including a display panel including a plurality of pixels, a timing controller for correcting an input image signal and transmitting the same to the display panel, and a memory for storing model correction data for correcting a gray value corresponding to respective models of a plurality of timing controllers, and for storing image quality correction data for correcting a gamma deviation of the display panel, the method including determining identification information of a timing controller, reading model data according to the identification information of the timing controller from among the model correction data, determining identification information of the display panel, reading the image quality data by using the identification information of the display panel, and generating final correction data by using the model correction data and the image quality correction data.

The method may further include transmitting the final correction data to the timing controller so that the timing controller may correct the image signal by using the final correction data.

The gamma deviation may include a difference between a measured gamma of the display panel when driven by the timing controller of a first model and a target gamma of the timing controller of the first model.

The gamma corrected by the model correction data may represent a gamma difference value corresponding to a difference between a difference value between a center-value gamma of the timing controller of a first model and a target gamma of the timing controller of the first model, and a difference value between a center-value gamma of the timing controller of a second model and a target gamma of the timing controller of the second model, wherein the center-value gamma includes a representative value of measured gammas for respective gray levels when driven by the timing controller of a given model of a plurality of display panels generated in a same manufacturing process as the display panel.

The center-value gamma may include a mean value or an intermediate value of measured gammas for respective gray levels of the plurality of display panels.

The gamma value corrected by the final correction data may be calculated by using $g(x)=CB(x)+d2-TB(x)$, $f(x)=CA(x)+d1-TA(x)$, $CA(x))=CB(x)+X$, and wherein, when $d1=d2$, $g(x)=CA(x)-X+d1-TB(x)=f(x)+(TB(x)-CB(x))-(TA(x)-CA(x))$, where $g(x)$ includes a gamma value corrected by the final correction data, $CB(x)$ includes a center-value gamma of the timing controller of the second model, $d2$ includes a gamma deviation of a display panel corrected corresponding to the timing controller of the second model, $TB(x)$ includes a target gamma of the timing controller of the second model, $f(x)$ includes a gamma value corrected by the image quality correction data, $CA(x)$ includes a center-value gamma of the timing controller of the first model, $d1$ includes a gamma deviation of the display panel corrected corresponding to the timing controller of the first model, and $TA(x)$ includes a target gamma of the timing controller of the first model.

A target gamma of the timing controller of the first model may be different from a target gamma of the timing controller of the second model.

The image quality correction data may be stored in different addresses of the memory according to a model of the timing controller.

The method may further include storing the final correction data in the memory.

The model correction data and the image quality correction data may be stored in a lookup table (LUT).

According to the described embodiments, various models of timing controllers may be used for one display panel, and productivity of the display panel may be increased by a single-time vision/image test.

BRIEF DESCRIPTION OF THE DRAWINGS

FIG. 5 shows an example of model correction data stored in a flash memory.

DETAILED DESCRIPTION

Figure 1:
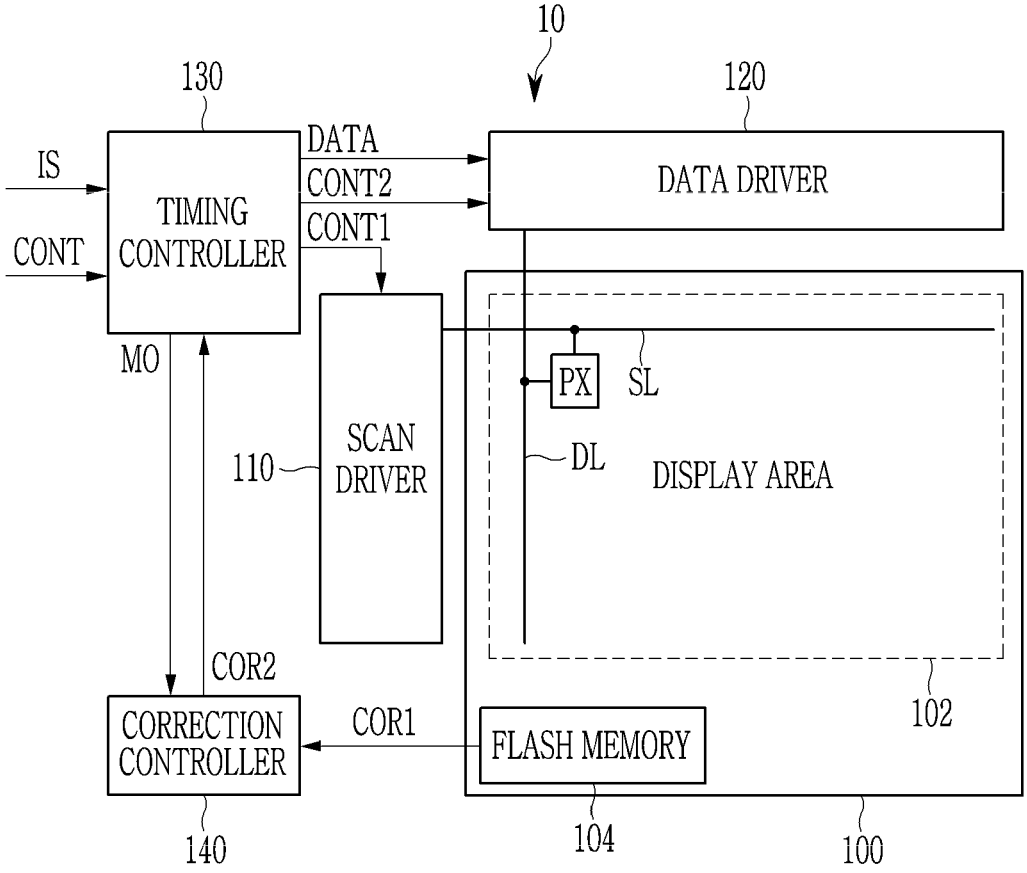
FIG. 1 shows a block diagram of a display device according to some embodiments.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described.

Unless otherwise noted, like reference numerals, characters, or combinations thereof denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

Further, in this specification, the phrase "on a plane," or "plan view," means viewing a target portion from the top, and the phrase "on a cross-section" means viewing a cross-section formed by vertically cutting a target portion from the side.

It will be understood that when an element, layer, region, or component is referred to as being "formed on," "on," "connected to," or "coupled to" another element, layer, region, or component, it can be directly formed on, on, connected to, or coupled to the other element, layer, region, or component, or indirectly formed on, on, connected to, or coupled to the other element, layer, region, or component such that one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When one or more embodiments may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 shows a block diagram of a display device according to some embodiments.

The display device 10 includes a display panel 100, a scan driver 110, a data driver 120, a correction controller 140, and a timing controller 130. Constituent elements described with reference to FIG. 1 might not be necessary in realizing the display device, so the display device described in the present specification may include a greater or lesser number of constituent elements than the above-arranged constituent elements.

The display device 10 may be an organic light emitting device or may be a liquid crystal display. Further, the display device 10 may be a flexible display device, a rollable display device, a curved display device, a transparent display device, and/or a mirror display device as the organic light emitting device.

The display panel 100 includes a display area 102 in which a plurality of pixels (PX) are positioned. A memory 104 may be located in a non-display area that is different from the display area 102.

For example, a plurality of pixels (PX) are located in the display area 102, and images may be displayed by the plurality of pixels (PX). The respective pixels (PX) may include a plurality of color (e.g., red, green, and blue) sub-pixels.

For example, the display panel 100 may include a plurality of pixels (PX) connected to a corresponding one from among a plurality of scan lines (SL) and to a corresponding one from among a plurality of data lines (DL).

The memory 104, which may be flash memory, stores model correction data (e.g., when driven by the timing controller corresponding to one of respective models), and also stores image quality correction data (e.g., when driven by a timing controller of a specific model). The model correction data and the image quality correction data may be stored in a lookup table (LUT), which will be described further below.

The scan driver 110 may provide a scan signal to the pixels (PX) of the display panel 100 through the scan lines (SL). The scan driver 110 may provide the scan signal to the display panel 100 based on a first control signal (CONT1) provided by the timing controller 130.

The data driver 120 may provide a data signal to the pixels (PX) of the display panel 100 through the data lines (DL). The data driver 120 selects a gray voltage according to an image data signal (DATA), and transmits information corresponding to the same as a data signal(s) to a plurality of data lines. For example, the data driver 120 samples and holds the image data signal (DATA) input by a control signal (CONT2), and transmits a plurality of data signals to a plurality of data lines (DL). The data driver 120 may apply a data signal having a voltage range (e.g., a predetermined voltage range) to a plurality of data lines (DL) while an enable-level scan signal is applied to a plurality of pixels (PX).

The timing controller 130 receives an image signal (IS), which may be received by an external graphics source, and an input control signal (CONT) for controlling the same. The image signal (IS) may include luminance information divided by grays, or gray levels, of the respective pixels (PX) of the display panel 100. The image signal (IS) may include red, green, and blue data corresponding to the respective red, green, and blue sub-pixels. The timing controller 130 may also receive correction data (COR2) from the correction controller 140.

The input control signal (CONT) transmitted to the timing controller 130 may include a vertical synchronization signal (Vsync), a horizontal synchronization signal (Hsync), a main clock signal MCLK, and a data enable signal (DE).

The timing controller 130 may generate the control signals (CONT1 and CONT2) and the image data signal (DATA) according to the image signal (IS), the correction data (COR2), the horizontal synchronization signal (Hsync), the vertical synchronization signal (Vsync), the main clock signal MCLK, the data enable signal (DE), etc.

The timing controller 130 appropriately image-processes the image signal (IS) according to an operating condition of the display panel 100 and the data driver 120 based on the input image signal (IS), the correction data (COR2), and the input control signal (CONT). For example, the timing controller 130 may generate an image data signal (DATA) by performing image processing such as gamma correction or luminance compensation on the image signal (IS) by using the correction data (COR2).

The correction controller 140 receives the model correction data and the image quality correction data (COR1) from the flash memory 104, generates final correction data (COR2) while considering both a model, or model type, of the timing controller 130 and a model, or model type, of the display panel 100 based on the received data, and transmits the final correction data (COR2) to the timing controller 130. The correction controller 140 may store the final correction data (COR2) in the flash memory 104.

According to some embodiments, the correction controller 140 may be realized with an additional application processor (AP). According to some embodiments, the correction controller 140 may be included in the timing controller 130. According to some embodiments, the correction controller 140 may be located on the display panel 100.

A method for driving the display device 10 will now be described in detail with reference to FIG. 2 and FIG. 3.

Figure 2:
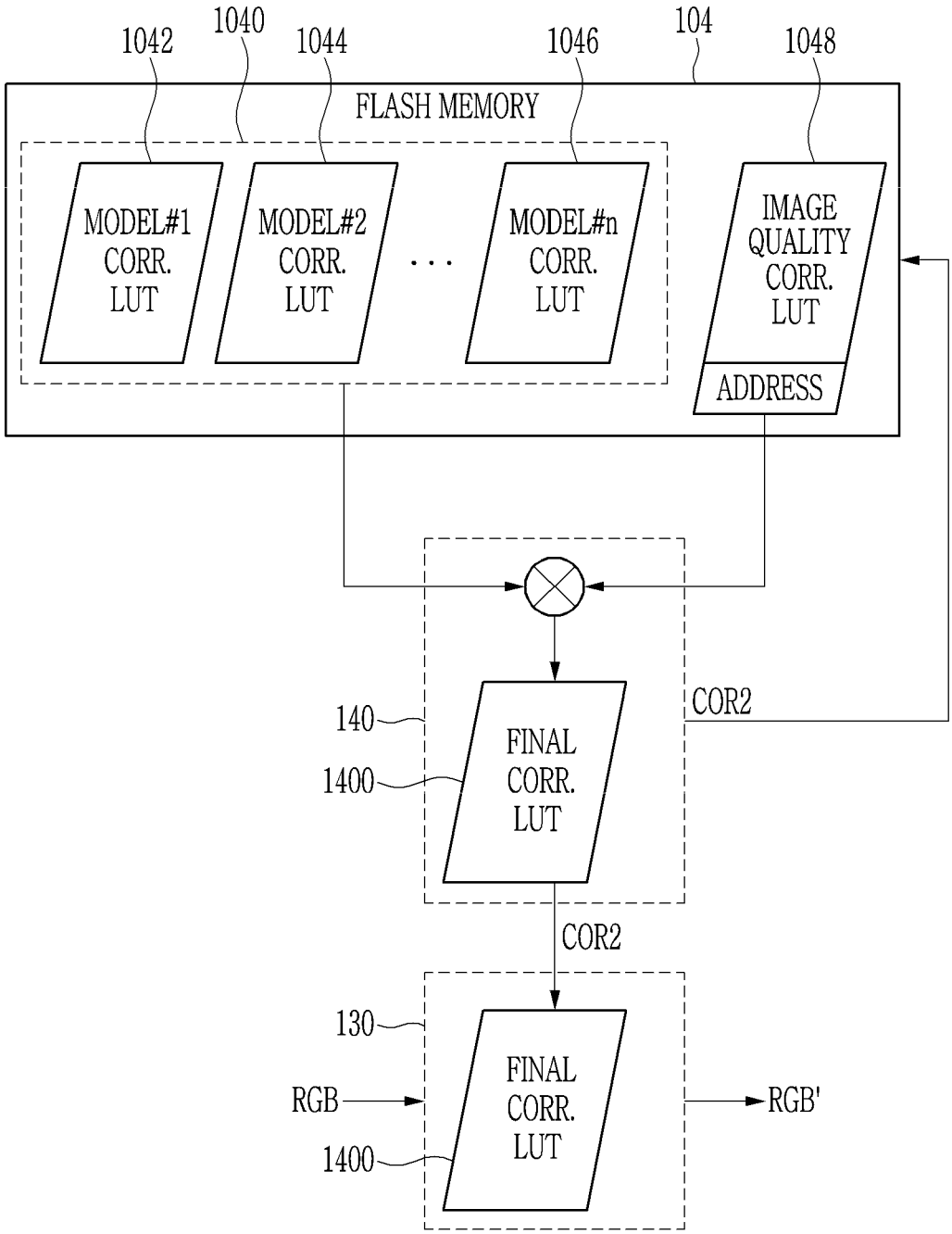
FIG. 2 shows a flash memory, a correction controller, and a timing controller according to some embodiments.
Figure 3:
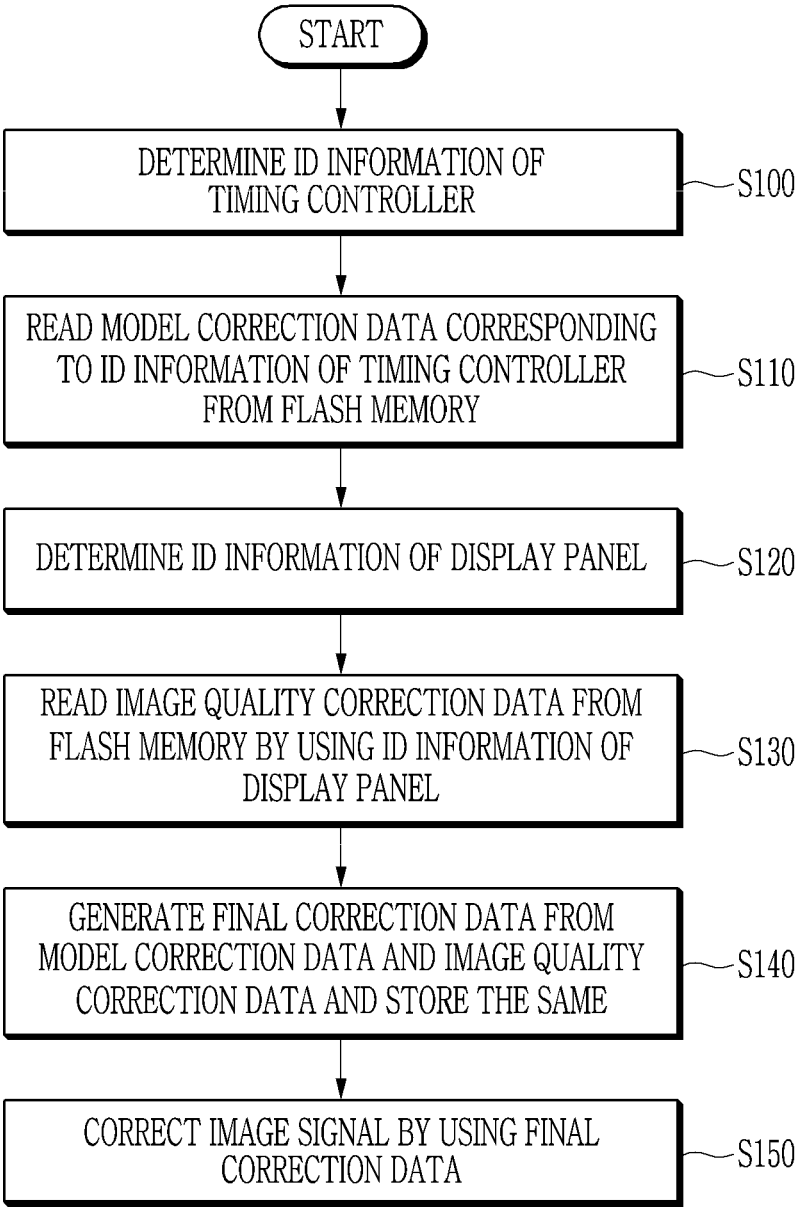
FIG. 3 shows a flowchart of a method for driving a correction controller and a timing controller.

FIG. 2 shows a flash memory, a correction controller, and a timing controller according to some embodiments, and FIG. 3 shows a flowchart of a method for driving a correction controller and a timing controller (e.g., the correction controller and the timing controller shown in FIG. 2).

As shown in FIG. 3, the correction controller 140 may determine identification information of the timing controller 130 (S100). The timing controller 130 may be manufactured as various types of models according to manufacturing companies, applied models, and applied panels. The same display panel 100 may generate different respective measured luminance profiles when driven by timing controllers 130 of different models. The correction controller 140 may receive an identification code (MO) (e.g., see FIG. 1) of the timing controller 130 from the timing controller 130 and may determine the model of the timing controller 130.

The correction controller 140 may read model correction data 1040 according to the model of the timing controller 130 from the flash memory 104 (S110). The flash memory 104 may store data for performing a color gamma correction when the corresponding display panel 100 is driven by the timing controllers of different models. The above-noted color gamma correction may be a color gamma correction according to material characteristic deviation caused by the manufacturing processes for the respective display panels 100.

The correction controller 140 may determine identification information of the display panel 100 (S120). The identification information of the display panel 100 may represent information for indicating by which model of the timing controller 130 the display panel 100 is preset to be driven. The correction controller 140 may read identification information of the display panel 100 stored in the flash memory 104.

The correction controller 140 may read image quality correction data 1048 by using the identification information of the display panel 100 (S130). The image quality correction data 1048 may represent data for correcting color gamma according to physical characteristic deviation caused by a process for manufacturing a display panel 100 for respective cells.

A position in which the image quality correction data 1048 is stored in the memory 104 depends on which model of the timing controller 130 the display panel 100 is to be driven (e.g., preset to be driven). When the model of the timing controller that is intended to drive the display panel 100 is different from the model of the timing controller 130 that is connected to the display panel 100 to drive the current display panel 100, addresses of the memory 104 in which the image quality correction data 1048 are stored may be incorrect (e.g., different addresses may be used for different models of timing controllers). Accordingly, the timing controller 130 driving the current display panel 100 might not correctly read the image quality correction data 1048 from the memory 104.

Therefore, the correction controller 140 may read the image quality correction data 1048 from the corresponding address(es) by determining the address(es) of the memory 104 in which the image quality correction data 1048 are stored by use of the identification information of the display panel 100.

The correction controller 140 combines model correction data 1042, 1044, or 1046 read from the memory 104 and the image quality correction data 1048 to generate final correction data 1400 (S140). The correction controller 140 transmits the generated final correction data 1400 to the timing controller 130.

The correction controller 140 may store the final correction data 1400 in a new address of the memory 104 corresponding to the model of the timing controller 130 driving the current display panel 100. In this case, the correction controller 140 may generate the final correction data 1400 once, and after that, the correction controller 140 may transmit the final correction data 1400 stored in the memory 104 to the timing controller 130, or the timing controller 130 may read the final correction data 1400 stored in the memory 104.

The model correction data, the image quality correction data, and the final correction data generated therefrom, will now be described with reference to FIG. 4, and correction of the image signal by using the final correction data (S150) will be described further below with reference to FIG. 5.

Figure 4:
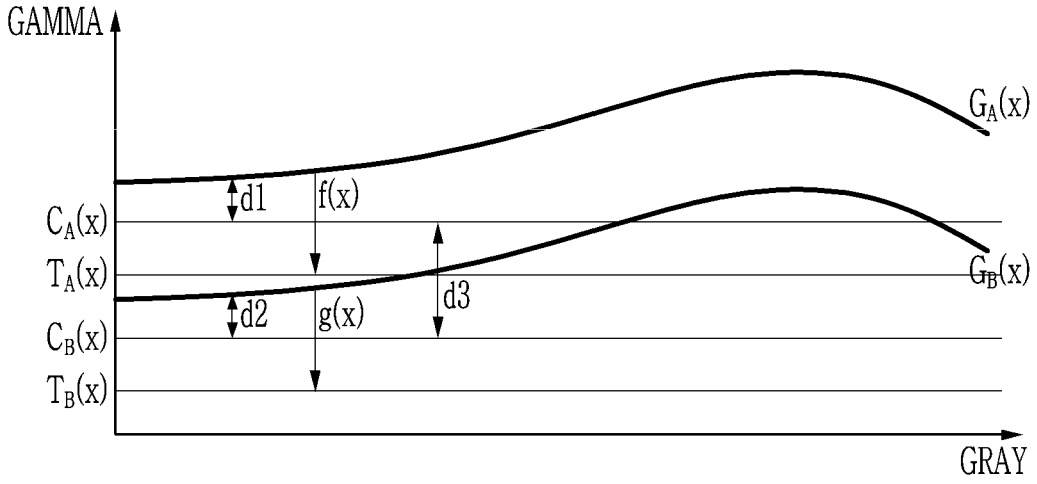
FIG. 4 shows a graph of model correction data and image quality correction data.

FIG. 4 shows a graph of model correction data and image quality correction data.

The same display panel, when driven by timing controllers of different models, may have different measured luminance profiles. Therefore, different respective measured gammas ($G_A(x)$ and $G_B(x)$), or gamma corrections, corresponding to the timing controllers of different models may be generated.

Therefore, in the case of N display panels generated in the same manufacturing process (N being an integer), a center value of the measured gammas when driven by a first model of the timing controller may be different from a center value of the measured gammas when driven by a different second model of the timing controller.

For example, the gammas for respective gray levels on i display panels (i being an integer that is less than N) from among the N display panels when driven by the timing controller of the first model may be measured by an image-testing device. The center-value of the measured gammas (e.g., a center-value gamma) for the respective gray levels of the i display panels driven by the timing controller of the first model are produced by using the measured gammas for the respective gray levels of the i display panels driven by the timing controller of the first model.

The center-value gamma is a representative value of the measured gammas for respective gray levels of a plurality of display panels when driven by the timing controller of a given type or model (e.g., of a predetermined model), and the center-value gamma may be a mean value or an intermediate value of the measured gammas for respective gray levels of a plurality of display panels. The center-value gamma ($C_A(x)$) of the first model is a representative value of the measured gammas for respective gray levels when a plurality of display panels are driven by the timing controller of the first model, and the center-value gamma ($C_B(x)$) of the second model is a representative value of the measured gammas for respective gray levels when a plurality of display panels are driven by the timing controller of the second model.

The model correction data may correct differences between the center-value gamma and a target gamma when the display panel generated by the same manufacturing process is driven by the timing controllers of different models. This will be described in a later portion of the present specification.

In another way, when the display panels generated by the same manufacturing process are driven by timing controllers of the same model, the measured gammas for respective gray levels measured for the respective display panels may be different from each other, so the respective measured gammas for respective gray levels may deviate from the target gamma. The image quality correction data, considering the deviation, may correct input data so that the respective display panel may express the target gamma ($T_A(x)/T_B(x)$).

As described above, the display panel 100 may include a memory 104 for storing the model correction data, which corresponds to different timing controllers of respective models, and image quality correction data when driven by the timing controller of a specific model.

The correction controller 140 may read the model correction data and the image quality correction data from the memory 104 to generate final correction data for correcting input gray data.

When the timing controller of the second model is attached to a display panel "A," which includes a memory for storing image quality correction data when driven by the timing controller of the first model, the correction controller 140 may read image quality correction data, and model correction data corresponding to the timing controller of the second model, from the memory. The correction controller 140 calculates final correction data by using the image quality correction data and the model correction data.

The image quality correction data may be used to compensate a difference between the measured gamma ($G_A(x)$) (e.g., center-value gamma ($C_A(x)$) of first model+gamma deviation d1 of display panel A) of the display panel A and the target gamma ($T_A(x)$) of the first model timing controller.

The final correction data may be used to compensate a difference between the measured gamma ($G_B(x)$) of the display panel A when driven by the timing controller of the second model and the target gamma ($T_B(x)$) of the timing controller of the second model.

A gamma value corrected by the image quality correction data will be referred to as an image quality correction value (f(x)), and a gamma value corrected by the final correction data will be referred to as a final correction value (g(x)).

When production of the display panel A is finished, it may be difficult to measure the gamma when the display panel A is driven by the timing controller of the second model. Therefore, the measured gamma ($G_B(x)$) of the display panel A, when driven by the timing controller of the second model, may be set to be the gamma that is a summation of a gamma deviation d2 of the panel A and a center-value gamma ($C_B(x)$) of the panel when driven by the second model.

The center-value gamma ($C_A(X)$) of the first model may be equivalent to, or different from, the center-value gamma ($C_B(x)$) of the second model. A difference d3 between the center-value gamma ($C_A(x)$) of the first model and the center-value gamma ($C_B(x)$) of the second model will be marked as X.

A final correction value may be calculated by using Equation 1 to Equation 4, and final correction data may be produced therefrom.

$$g(x) = C_B(x) + d2 - T_B(x) \quad \text{Equation 1}$$

$$f(x) = C_A(x) + d1 - T_A(x) \quad \text{Equation 2}$$

$$C_A(x) = C_B(x) + X \quad \text{Equation 3}$$

$$\text{If } d1 = d2, \quad \text{Equation 4}$$
$$g(x) = C_A(x) - X + d1 - T_B(x)$$
$$= f(x) + (T_B(x) - C_B(x)) - (T_A(x) - C_A(x))$$

Here, g(x) is a final correction value, $C_B(x)$ is a center-value gamma of a second model, d2 is a gamma deviation of a display panel corrected with a second model, $T_B(x)$ is a target gamma of a second model, f(x) is an image quality correction value, $C_A(x)$ is a center-value gamma of a first model, d1 is a gamma deviation of a panel corrected with a first model, and $T_A(x)$ is a target gamma of a first model.

In Equation 4, one display panel 100 operates using the timing controller of a different model, so the gamma deviation of the display panel corrected with the first model is equivalent to the gamma deviation of the display panel corrected with the second model. The model correction data are used to correct the gamma by a value of $(T_B(x)-C_B(x))-(T_A(x)-C_A(x))$. The model correction data will now be described with reference to FIG. 5.

FIG. 5 shows an example of model correction data stored in a flash memory (e.g., the flash memory shown in FIG. 2).

Regarding the model correction data, red, green, and blue gamma correction data respectively corresponding to red, green, and blue data R, G, and B, which may be input data, may be stored in a lookup table. The model correction data have different values according to the model of the timing controller 130.

The timing controller 130 performs a color gamma correction corresponding to the red, green, and blue data (RGB) of the image signal (IS) by using the final correction data 1400 to thereby correct the image signal (S150). The timing controller 130 may output the color gamma corrected data (RGB') to the data driver 120.

The image quality correction data previously may have had to be generated again by using the image-testing device when the image quality correction data were determined for the respective models of the timing controller 130 and when the model of the timing controller 130 connected to the display panel 100 was changed.

However, according to the present disclosure, normal image quality correction data may be generated with the image quality correction data of a specific model without using an image-testing device even when changing the model of the timing controller. Therefore, it is easy to change the model of the timing controller 130 to be effectively combined to the display panel 100, thereby increasing productivity, and enabling the responding to delivery deadlines in a flexible way.

While embodiments of the present disclosure have been described in connection with what is presently considered to be practical embodiments, it is to be understood that the invention is not limited to the disclosed embodiments, but, on the contrary, is intended to cover various modifications and equivalent arrangements included within the spirit and scope of the appended claims, with functional equivalents thereof to be included therein.

What is claimed is:

1. A display device comprising:

a display panel comprising a plurality of pixels;

a timing controller for correcting an input image signal, and for transmitting the input image signal to the display panel;

a memory for storing model correction data for correcting a gray value, the model correction data corresponding to respective models of a plurality of timing controllers, and for storing image quality correction data for correcting a gamma deviation of the display panel; and a correction controller for generating final correction data by using the model correction data and the image quality correction data, and for transmitting the final correction data to the timing controller.

2. The display device of claim 1, wherein the gamma deviation comprises a difference between a measured gamma of the display panel when driven by a timing controller of a first model and a target gamma of the timing controller of the first model.

3. The display device of claim 2, wherein the gamma deviation corrected by the model correction data represents a gamma difference value corresponding to a difference between a difference value between a center-value gamma of the timing controller of the first model and a target gamma of the timing controller of the first model, and a difference value between a center-value gamma of a timing controller of a second model and a target gamma of the timing controller of the second model, and wherein the center-value gamma comprises a representative value of measured gammas for respective gray levels when driven by the timing controller of a given model of a plurality of display panels generated in a same manufacturing process as the display panel.

4. The display device of claim 3, wherein the center-value gamma comprises a mean value or an intermediate value of measured gammas for respective gray levels of the plurality of display panels generated in the same manufacturing process.

5. The display device of claim 3, wherein a gamma value corrected by the final correction data is calculated by using:

$$g(x)=C_B(x)+d2-T_B(x),$$

$$f(x)=C_A(x)+d1-T_A(x),$$

$$C_A(x))=C_B(x)+X, \text{ and}$$

wherein, when d1=d2, $g(x)=C_A(x)-X+d1-T_B(x)=f(x)+(T_B(x)-C_B(x))-(T_A(x)-C_A(x))$, where g(x) comprises the gamma value corrected by the final correction data, $C_B(x)$ comprises a center-value gamma of the timing controller of the second model, d2 comprises a gamma deviation of a display panel corrected corresponding to the timing controller of the second model, $T_B(x)$ comprises a target gamma of the timing controller of the second model, f(x) comprises a gamma value corrected by the image quality correction data, $C_A(x)$ comprises a center-value gamma of the timing controller of the first model, d1 comprises a gamma deviation of the display panel corrected corresponding to the timing controller of the first model, $T_A(x)$ comprises a target gamma of the timing controller of the first model, and X comprises a difference between CA(x) and CB(x).

6. The display device of claim 3, wherein a target gamma of the timing controller of the first model is different from a target gamma of the timing controller of the second model.

7. The display device of claim 1, wherein the image quality correction data are stored in different addresses of the memory according to a model of the timing controller.

8. The display device of claim 1, wherein the timing controller is configured to correct the input image signal by using the final correction data, and wherein the correction controller is configured to store the final correction data in the memory.

9. The display device of claim 1, wherein the model correction data and the image quality correction data are stored in a lookup table (LUT).

10. The display device of claim 1, wherein the pixels respectively comprise red, green, and blue sub-pixels, and wherein the input image signal comprises red, green, and blue data.

11. A method for driving a display device comprising a display panel comprising a plurality of pixels, a timing controller for correcting an input image signal and transmitting the input image signal to the display panel, and a memory for storing model correction data for correcting a gray value corresponding to respective models of a plurality of timing controllers, and for storing image quality correction data for correcting a gamma deviation of the display panel, the method comprising:

determining identification information of a timing controller;

reading model data according to the identification information of the timing controller from among the model correction data;

determining identification information of the display panel;

reading the image quality correction data by using the identification information of the display panel; and generating final correction data by using the model correction data and the image quality correction data.

12. The method of claim 11, further comprising transmitting the final correction data to the timing controller so that the timing controller may correct the input image signal by using the final correction data.

13. The method of claim 12, wherein the gamma deviation comprises a difference between a measured gamma of the display panel when driven by the timing controller of a first model and a target gamma of the timing controller of the first model.

14. The method of claim 13, wherein the gamma deviation corrected by the model correction data represents a gamma difference value corresponding to a difference between a difference value between a center-value gamma of the timing controller of a first model and a target gamma of the timing controller of the first model, and a difference value between a center-value gamma of the timing controller of a second model and a target gamma of the timing controller of the second model, and wherein the center-value gamma comprises a representative value of measured gammas for respective gray levels when driven by the timing controller of a given model of a plurality of display panels generated in a same manufacturing process as the display panel.

15. The method of claim 14, wherein the center-value gamma comprises a mean value or an intermediate value of measured gammas for respective gray levels of the plurality of display panels.

16. The method of claim 14, wherein a gamma value corrected by the final correction data is calculated by using:

$$g(x)=C_B(x)+d2-T_B(x),$$

$$f(x)=C_A(x)+d1-T_A(x),$$

$$C_A(x))=C_B(x)+X, \text{ and}$$

wherein, when d1=d2, $g(x)=C_A(x)-X+d1-T_B(x)=f(x)+(T_B(x)-C_B(x))-(T_A(x)-C_A(x))$, where g(x) comprises the gamma value corrected by the final correction data, $C_B(x)$ comprises a center-value gamma of the timing controller of the second model, d2 comprises a gamma deviation of a display panel corrected corresponding to the timing controller of the second model, $T_B(x)$ comprises a target gamma of the timing controller of the second model, f(x) comprises a gamma value corrected by the image quality correction data, $C_A(x)$ comprises a center-value gamma of the timing controller of the first model, d1 comprises a gamma deviation of the display panel corrected corresponding to the timing controller of the first model, $T_A(x)$ comprises a target gamma of the timing controller of the first model, and X comprises a difference between CA(x) and CB(x).

17. The method of claim 14, wherein a target gamma of the timing controller of the first model is different from a target gamma of the timing controller of the second model.

18. The method of claim 11, wherein the image quality correction data are stored in different addresses of the memory according to a model of the timing controller.

19. The method of claim 11, further comprising storing the final correction data in the memory.

20. The method of claim 11, wherein the model correction data and the image quality correction data are stored in a lookup table (LUT).

* * * * *